United States Patent [19]

Cyphelly

[11] 4,173,303

[45] Nov. 6, 1979

[54] HYDRAULIC PUSH DRIVE FOR PUSHER CENTRIFUGES

[76] Inventor: Ivan J. Cyphelly, Neuhaus, Hinteregg, Switzerland, 8128

[21] Appl. No.: 805,222

[22] Filed: Jun. 9, 1977

[30] Foreign Application Priority Data

Jun. 15, 1976 [CH] Switzerland ..... 7637/76

[51] Int. Cl.[2] ..... B04B 9/06; F15B 21/02

[52] U.S. Cl. ..... 233/24; 91/40; 233/6; 91/422

[58] Field of Search ..... 91/40, 39, 422; 92/106; 210/374; 233/24, 5, 6

[56] References Cited

U.S. PATENT DOCUMENTS

| | | | |
|---|---|---|---|
| 198,610 | 12/1877 | Harrison | 91/40 |
| 1,390,834 | 9/1921 | Stage | 91/40 |
| 2,809,612 | 10/1957 | Highberg | 92/106 |
| 3,171,809 | 3/1965 | Cox | 92/106 |

*Primary Examiner*—Paul E. Maslousky
*Attorney, Agent, or Firm*—Browdy and Neimark

[57] ABSTRACT

A hydraulic push drive for pusher centrifuges, having a rotating body with a cylindrical bore. The rotating body is provided with a piston rod and piston body therein. A rotary control valve is disposed in the rotating body. The rotary control valve is driven by a hydraulic motor and controls the application of pressure. A valve is slideably mounted in a coaxial bore in the piston rod in order to control the stroke center of the piston by pulse duration modulation of a controlled leakage flow.

5 Claims, 1 Drawing Figure

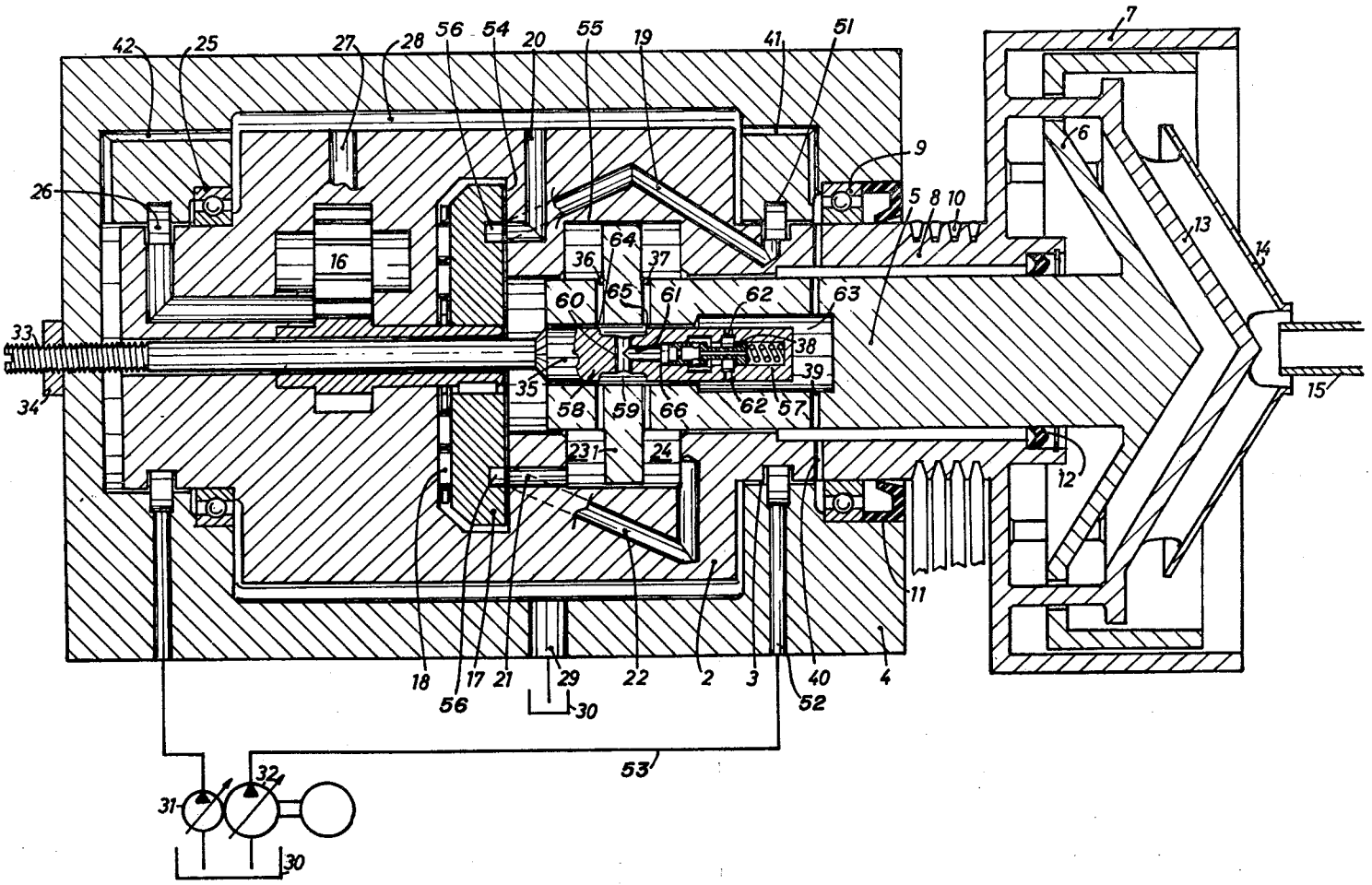
15
14
13
7
6
12
10
8
5
9
11
4
51
63
40
52
41
38
39
57
62
62
3
2
19
37
61
66
24
22
53
64
65
59
55
36
60
58
23
29
30
20
35
21
54
17
56
56
28
18
27
16
32
30
25
31
42
26
33
34

HYDRAULIC PUSH DRIVE FOR PUSHER CENTRIFUGES

BACKGROUND OF THE INVENTION

This invention relates to a hydraulic push drive for a pusher centrifuge, with a piston and a piston rod located in a rotating piston body. The present invention is concerned, more particularly, with such a hydraulic drive which is designed to permit during operation controlling of stroke length and stroke center, even at high switching rates and/or high stroke frequencies.

In larger machines, push drives for pusher centrifuges operate by a direct hydraulic principle, i.e., by means of alternate pressure application to a piston rotating with the basket of the centrifuge. The problems associated with this type of drive involve the reversal of the pressure application at the end of the stroke; with a stop-actuated reversing valve in the piston body, a simple solution is available, but one in which the stroke length cannot be adjusted during operation and which must be rejected in view of the fact that adjustments of stroke length and stroke center are required by chemical engineering considerations.

Makeshift solutions involving electronic scanning of the stroke movement and operation of electrohydraulic valves have been proposed, but are sharply limited in application by the switching rate of the valves.

SUMMARY OF THE INVENTION

It is the principal object of the present invention to provide a hydraulic push drive for a pusher centrifuge which overcomes the shortcomings mentioned above and effects control of the stroke center during operation.

This is accomplished according to the invention by disposing a rotary control valve in the rotating body, this valve controlling the pressure applications and being driven by a hydraulic motor. In addition, a valve is slideably mounted in a coaxial bore in the piston rod in order to be able to determine the stroke center of the piston by pulse duration modulation of a controlled leakage flow.

The coaxial valve can be designed so that its axial position can be changed from the outside, i.e., the stroke center can be displaced in conjunction with the alternating application of pressure to the piston during the operation of the machine. The accuracy of determination of the center can be accomplished by using a flow-regulating valve connected downstream from the coaxial valve, the flow-control valve permitting a constant leak from the piston chamber independently of the pressure value.

BRIEF DESCRIPTION OF THE DRAWING

The sole FIGURE of drawing is a lengthwise cross-section view of an exemplary embodiment of a hydraulic push drive in accordance with the present invention in operative association with a portion of an assembled pusher centrifuge.

DETAILED DESCRIPTION OF THE PREFERRED EMBODIMENT

The push drive shown in the drawing FIGURE includes a piston 1 in a rotating body 2, whereby the oil which exerts pressure upon the piston passes through a passageway 3 from a fixed housing 4 to the rotating parts. The force of the piston 1 is transmitted by a piston rod 5 to a pusher part 6 in a basket 7. The basket 7 is connected to the body 2 by a hollow shaft 8, this shaft resting on the housing 4 at a bearing 9 and provided with a pulley drive at 10 for effecting rotational movement. Seals 11 and 12 prevent hydraulic fluid from escaping into the processing area. A distributor cone 13, a cap 14, and a feed pipe 15, all known conventional machine parts which are a function of the centrifuging process to be preformed do not require explanation in conjunction with the push drive. As thus far described, the pusher centrifuge and drive are conventional.

The components corresponding to the invention are a rotary control valve 17, driven by a hydraulic motor 16 (here shown as a gear motor), the rotary control valve 17 being supported on the piston body 2 by a roller bearing 18 and alternately connecting a supply passage 19 and an exhaust 20 with piston connections 21 and 22, respectively, corresponding to chambers 23 and 24.

The rotary control valve 17 is identical to the valve disclosed in U.S. Pat. No. 3,768,516, except that in the present invention the hydraulic motor 16 drives the valve 17, instead of an operating handle (element 14 in U.S. Pat. No. 3,768,516, hereby incorporated by reference).

Rotary control valve 17 alternately supplies and exhausts fluid to chambers 23 and 24. When valve 17 is in a first position, fluid is supplied to chamber 23 from supply passage 19, through valve 17, and piston connection 21. Simultaneously, chamber 24 is exhausted of fluid, as the fluid flows from chamber 24 through piston connection 22, valve 17 and exhaust 20. When the valve 17 is in a second position, the internal connections in valve 17 are reversed whereby fluid is supplied to chamber 24, and chamber 23 is exhausted.

The hydraulic motor 16 is supplied with fluid through a passageway 26 provided next to a rear bearing 25. An exhaust 27 goes to a collecting chamber 28 and back to a reservoir 30 via a stub passage 29. A variable pump 31 controls the rpm of the hydraulic motor 16, and consequently, controls the stroke frequency of the piston 1 by action of the coupled rotary control valve 17. Similarly, adjustment of a second pump 32 determines the stroke length of the piston 1, with the stroke frequency remaining constant.

A valve 35, axially adjustable by a spindle 33 and a lock nut 34, connects the chamber 23 or 24, depending on its position, with a flow control valve 38 via bores 36 and 37, depending on the position of piston 1.

The rotary control valve 17 has a valve plane 54 in which the open ends of the four passages or conduits 19, 20, 21 and 22 lie. The passage or conduit 19 eventually is connected to the supply terminal of the second pump 32, the passageway being from the passage or conduit 19 to an annular conduit, designed as a groove, from there to a radial bore and through a schematically represented outer line.

The passage or conduit 20 is connected to the collecting chamber 28 which in turn is in connection, via the stub passage 29, with the open reservoir 30 having no pressure. Therefore the passage or conduit 20 is an exhaust passage. The passage or conduit 21 is open to the chamber 23 on the one side of the piston 1; the passage or conduit 22 is open to the chamber 24 on the other side of piston 1. The chambers 23, 24 are part of an annular groove 55 in the body 2, and separated by the piston 1, which is integral with the piston rod 5. The piston rod 5 with the piston 1 can axially move from one end of the groove 55 to the other. As made clear in the drawing, the passages or conduits 19, 20, 21, 22 are open in the valve plane 54 at different locations (see dashed lines of the passages 19 and 22).

The valve 35 has two input ports, each connected and disconnected to one of the chambers 23, 24 by the displacement of the piston 1 during a piston stroke, and an output port connected to the flow control valve 38, for alternately producing a leakage current of fluid from each chamber 23,24. Fluid current is from bores 36 and 37, which are at high pressure to leakage bores 39 and 40 via the flow control valve 38.

The valve 35 is built into the piston rod 5; it cannot be separated, therefore, from the piston rod 5 and the piston 1, both being parts of this valve. The valve 35 includes a valve body 57 inserted in an axial bore 58 in the piston rod 5 in such manner that the axially movable piston rod 5 glides over the outer cylindrical surface of the valve body 57. The plurality of the radial bores 36, 37 in the piston rod 5 is located in extensions of both side faces of the piston 1 in the groove 55. An annular groove 59 is provided in the valve body 57, the axial width of which is less than the maximum axial spacing between the bores 36 and 37. A diametrical bore 60 is provided in the valve body 57 connecting two opposite locations in a groove 59. A central axial bore 61 is connected to a diametrical bore 60. The spring-loaded flow control valve 38 is positioned in the bore 60. Radial bores 62 in valve body 57 connects the output side of the flow control valve 38 to a portion 63 of the bore 58 having a larger diameter.

The piston rod 5 is shown in such position that the piston 1 is in a central position in the groove 55, the chambers 23 and 24 having the same axial length. The axially adjustable valve 35 is shown in a symmetrical position with respect to the bores 36 and 37; i.e. both edges of the annular groove 59 have the same position with respect to the bores 36 and 37, respectively. The groove 59 thus connects the bores 36 and 37 in the position shown.

During reciprocating movement of the piston 1 and, therefore, the piston rod 5 as a function of pressure and exhaust alternately applied to chambers 23, 24 through the rotary valve 17, an inner wall surface of the piston rod 5 forming the bore 58 and including the open ends of the bores 36, 37 glides over the annular groove 59. In a position of piston 1 to right of its position, shown, the bore 37 will be completely closed by the valve body 37, whilst the bore 36 will be completely open to the groove 59. In that case the chamber 23, with which the bore 36 communicates, is the chamber under fluid pressure, fluid will flow through the bores 60, 61 and through the flow control valve 38 to the bores 39, 40, 41 and to the reservoir 30, the flow rate being controlled by the valve 38.

By the leakage flow provided as set out above, pressure in the respective chamber 23 will be reduced resulting in a reduction of the stroke length of the piston 1 in the respective direction to the right. The same thing happens when the piston 1 travels in the opposite direction the bore 37 and the chamber 24 being now involved with respect to leakage flow and pressure reduction, respectively, the bore 36 now being closed by valve body 57.

If the stroke center does not correspond to the midpoint of the valve, a drifting movement controlled by the volume of the leak is superimposed on the actual stroke movement, since the chamber to be shortened is automatically connected for a longer period of time with the flow control valve 38 than the chamber to be lengthened. In other words, when there is a difference between the stroke center and the valve midpoint, the leak pulses are modulated as a function of time in such manner that there is a drift toward coincidence (at which point the leak pulses of the two chambers are of equal length). Therefore, the stroke center follows the adjustable midpoint.

It is apparent that whenever the center of the stroke of piston 1 does not coincide with the center plane or center line of the groove 59 (or in other terms with the axis of bore 60 in the drawing), the reduction of pressure by leakage flow will be longer in the chamber, which has a greater axial length relative to the displaced stroke center than in the other chamber, which is exposed for shorter time to leakage flow. Thus the force exerted on the piston 1 by the latter chamber will be higher, and the stroke center will be moved accordingly until it coincides with the center of the groove 59. This is also the case if for any reason the valve 35 and correspondingly the center fo the groove 59 is shifted to the right or left by the spindle 33.

It is clear from the drawing that a first input port 64 of the valve 35 is formed by the groove 59 and the bore 36, and a second input port 65 is formed by the same groove 59 and the bore 37. The output port 66 of the valve 35 is the open end of a bore 61.

From the drawing it can be seen that the groove 59 should have a minimum axial length corresponding to the axial length of the chamber 23 or 24 when the piston 1 is in the center position in the groove 55. The minimum length of the groove 59 has the result that in the center position of the piston 1 with respect to the center of groove 59, that groove connects the chambers 23 and 24 with the spacing of the bores 36 and 37. Such by-pass flow from one chamber to the other has no marked effect, however, because the period of by-pass is extremely short as compared with the time of one complete stroke of piston 1. In practice, one can hardly notice a very short "pfff" sound of fluid passing from one chamber to the other, no effect being perceptible, however, in the measuring value of pressure.

The leakage passes from the flow control 38, via bores 39 and 40, to the bearing 9 where it combines with leakage from the passageway 3 to lubricate the bearing. From a bore 41 the leakage then passes to the collecting chamber 28. The same applies to the leakage from the passageway 26 and a bore 42.

With respect to the construction, it should be added that nearly all types of rotary valves and hydraulic motors can be used. In view of the centrifugal force and thermal deformation, the combination of a radial piston motor with the valve according to U.S. Pat. No. 3,768,516 has indisputable advantages as a control element. The elements according to U.S. Pat. No. 3,685,842 can be used as passageways, and in small machines a simple diaphragm throttle will often suffice instead of the illustrated flow control valve 38.

It is to be appreciated that the foregoing description and accompanying drawing relate to a particular embodiment and variants given by way of example, not by way of limitation. Numerous other embodiments and variants are possible without departing from the spirit and scope of the invention, its scope being defined by the appended claims.

It will be obvious to those skilled in the art that various changes may be made without departing from the scope of the invention and the invention is not to be considered limited to what is shown in the drawing and described in the specification.

What is claimed is:

1. In a hydraulic push drive for a pusher centrifuge having a rotating body with a centrifuge basket attached thereto and a coaxial cylindrical bore therein, a piston disposed in said cylindrical bore defining respective chambers in said cylindrical bore on each side of said piston, said piston being provided with a coaxial piston rod extending beyond said rotating body and having a centrifuge pusher attached thereto, said centrifuge pusher being disposed within said centrifuge basket for simultaneous rotation therewith and a fluid means for supplying a fluid under pressure from a fixed housing to said rotating body, the improvement comprising:

a hydraulic motor, disposed in said rotating body and connected to said fluid means;

a rotary control valve means disposed in said rotating body, for controlling the flow of fluid into and out of said chambers in said cylindrical bore, wherein said hydraulic motor drives said rotary control valve means;

a first fluid control means, disposed outside said rotating body, for controlling the flow of fluid supplied to said hydraulic motor and thereby controlling the stroke frequency of said piston;

a second fluid control means, disposed outside said rotating body, for controlling the flow of fluid supplied to said rotary control valve means and thereby controlling the stroke length of said piston; and a sensing valve means, disposed in said rotating body, for sensing the pressure applied to said piston and for producing a leakage current flowing from each chamber of said cylindrical bore for controlling the stroke center of said piston, said sensing valve means, said first fluid control means and said second fluid control means controlling, independently, the stroke center, the stroke frequency, and the stroke length of said piston, respectively.

2. A hydraulic push drive, according to claim 1, wherein said rotary control valve means includes an intake passage for receiving fluid;

an exhaust passage for exhausting fluid; and two chamber passages, each of said chamber passages connected to one of said chambers on each side of said piston in said cylindrical bore in said rotating body.

3. A hydraulic push drive, according to claim 1, wherein said sensing valve means is slidably mounted in a coaxial bore in said piston rod and further includes two ports, each connected and disconnected to one of said chambers on each side of said piston by the displacement of said piston during a piston stroke;

an output port; and a flow regulator means, connected at one end to said output port, for regulating the flow of the leakage current from each of said chambers.

4. A hydraulic push drive, according to claim 1, further including an axial spindle means, for displacing said sensing valve means from outside said hydraulic push drive while said centrifuge is in operation, said axial spindle means being disposed axially in the cylindrical bore in said piston rod, thereby allowing adjustment of the stroke center of said piston.

5. A hydraulic push drive, according to claim 4, wherein said sensing valve means is slidably mounted in a coaxial bore in said piston rod and further includes two ports, each connected and disconnected to one of said chambers on each side of said piston by the displacement of said piston during a piston stroke;

an output port; and a flow regulator means, connected at one end to said output port, for regulating the flow of the leakage current from each of said chambers.

* * * * *